US011309620B2

(12) United States Patent
Ji et al.

(10) Patent No.: US 11,309,620 B2
(45) Date of Patent: Apr. 19, 2022

(54) DUAL-BAND ANTENNA AND WIRELESS COMMUNICATIONS DEVICE

(71) Applicant: Huawei Technologies Co., Ltd., Shenzhen (CN)

(72) Inventors: Xinghui Ji, Suzhou (CN); Bo Yuan, Suzhou (CN); Rui Hua, Suzhou (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 473 days.

(21) Appl. No.: 16/204,564

(22) Filed: Nov. 29, 2018

(65) Prior Publication Data

US 2019/0165450 A1 May 30, 2019

(30) Foreign Application Priority Data

Nov. 29, 2017 (CN) ..... 201711223861.6

(51) Int. Cl.
*H01Q 1/22* (2006.01)
*H01Q 1/38* (2006.01)
(Continued)

(52) U.S. Cl.
CPC ..... *H01Q 1/2291* (2013.01); *H01Q 1/38* (2013.01); *H01Q 1/521* (2013.01); *H01Q 5/30* (2015.01);
(Continued)

(58) Field of Classification Search
CPC ..... H01Q 21/0075; H01Q 21/061; H01Q 21/062; H01Q 21/065; H01Q 21/24;
(Continued)

(56) References Cited

U.S. PATENT DOCUMENTS 3,747,114 A 7/1973 Shyhalla
5,554,995 A * 9/1996 Jun ..... H01Q 21/0075 343/700 MS
(Continued)

FOREIGN PATENT DOCUMENTS

CN 102117964 A 7/2011
CN 102163768 A 8/2011
(Continued)

OTHER PUBLICATIONS

Decision to grant a European Patent, Application 18209190.0, European Patent Office, dated May, 7, 2021. (Year: 2021).*
(Continued)

*Primary Examiner* — Dameon E Levi
*Assistant Examiner* — Jennifer F Hu
(74) *Attorney, Agent, or Firm* — Conley Rose, P.C.

(57) ABSTRACT

A dual-band antenna and a wireless communications device, where the dual-band antenna includes a first antenna arranged on a first printed circuit board (PCB), a second antenna arranged on a second PCB, and a reflection panel. An operating frequency band of the first antenna is a first frequency band. An operating frequency band of the second antenna is a second frequency band. The first frequency band is higher than the second frequency band. The second PCB is disposed between the first PCB and the reflection panel. The reflection panel includes an artificial magnetic conductor. A resonant frequency band of the artificial magnetic conductor includes the second frequency band. The first frequency band is outside the resonant frequency band. The dual-band antenna has a small size.

20 Claims, 5 Drawing Sheets

(51) Int. Cl.

| | |
|---|---|
| ***H01Q 9/16*** | (2006.01) |
| ***H01Q 19/10*** | (2006.01) |
| ***H01Q 5/30*** | (2015.01) |
| ***H01Q 1/52*** | (2006.01) |
| ***H01Q 21/06*** | (2006.01) |
| ***H01Q 15/00*** | (2006.01) |
| ***H01Q 21/00*** | (2006.01) |
| ***H01Q 21/28*** | (2006.01) |
| ***H01Q 9/06*** | (2006.01) |
| ***H01Q 5/42*** | (2015.01) |

(52) U.S. Cl.
CPC ..... *H01Q 5/42* (2015.01); *H01Q 9/065* (2013.01); *H01Q 9/16* (2013.01); *H01Q 15/008* (2013.01); *H01Q 19/108* (2013.01); *H01Q 21/0075* (2013.01); *H01Q 21/062* (2013.01); *H01Q 21/28* (2013.01)

(58) Field of Classification Search
CPC .... H01Q 21/28; H01Q 21/293; H01Q 1/2291; H01Q 5/42; H01Q 15/00–15/0093; H01Q 19/108; H01Q 9/065; H01Q 9/285
See application file for complete search history.

(56) References Cited

U.S. PATENT DOCUMENTS

| | | | | |
|---|---|---|---|---|
| 6,470,174 | B1 | 10/2002 | Schefte et al. | |
| 8,451,189 | B1 * | 5/2013 | Fluhler | H01Q 15/0086 343/909 |
| 9,391,375 | B1 * | 7/2016 | Bales | H01Q 21/24 |
| 2013/0285858 | A1 | 10/2013 | Grange et al. | |
| 2014/0111396 | A1 * | 4/2014 | Hyjazie | H01Q 1/52 343/798 |
| 2015/0270622 | A1 | 9/2015 | Takasaki et al. | |
| 2018/0269577 | A1 * | 9/2018 | Kosaka | H01Q 5/45 |

FOREIGN PATENT DOCUMENTS

| | | | |
|---|---|---|---|
| CN | 103367881 | A | 10/2013 |
| CN | 104685718 | A | 6/2015 |
| CN | 104979642 | A | 10/2015 |
| CN | 104993226 | A | 10/2015 |
| CN | 205319332 | U | 6/2016 |
| CN | 107046183 | A | 8/2017 |
| CN | 107394412 | A | 11/2017 |
| EP | 2636096 | B1 | 2/2015 |
| WO | 2017056437 | A1 | 4/2017 |

OTHER PUBLICATIONS

Notification to Grant Patent Right for Invention Application No. 201711223861.6, State Intellectual Property Office of People's Republic of China, dated Mar. 22, 2021. (Year: 2021).*

Lin, J., et al., "A Low-Profile Dual-Band Dual-Mode and Dual-Polarized Antenna Based on AMC," IEEE Antennas and Wireless Propagation Letters, vol. 16, 2017, 4 pages.

He, S., et al.,"Analysis and Design of a Novel Dual-Band Array Antenna With a Low Profile for 2400/5800-MHz WLAN Systems", XP011298050, IEEE Transactions on Antennas and Propagation vol. 58 No. 2, Feb. 2010, 6 pages.

Foreign Communication From a Counterpart Application, European Application No. 18209190.0, Extended European Search Report dated Apr. 23, 2019, 10 pages.

He, S., et al., "Analysis and Design of a Novel Dual-Band Array Antenna With a Low Profile for 2400/5800-MHz WLAN Systems," IEEE Transactions on Antennas and Propagation, USA, IEEE, vol. 58, No. 2, Feb. 2010, pp. 391-396.

Foreign Communication From a Counterpart Application, Japanese Application No. 2018-222184, Japanese Office Action dated Nov. 5, 2019, 3 pages.

Foreign Communication From a Counterpart Application, Japanese Application No. 2018-222184, English Translation of Japanese Office Action dated Nov. 5, 2019, 3 pages.

Yang, D., et al., "A Dual-band MIMO Antenna loaded with AMC," Proceedings of the 2017 National Microwave and Millimeter Wave Conference, May 8, 2017, with an English abstract, 4 pages.

* cited by examiner

DUAL-BAND ANTENNA AND WIRELESS COMMUNICATIONS DEVICE

CROSS-REFERENCE TO RELATED APPLICATIONS

This application claims priority to Chinese Patent Application No. 201711223861.6 filed on Nov. 29, 2017, which is hereby incorporated by reference in its entirety.

TECHNICAL FIELD

This application relates to the communications field, and in particular, to a dual-band antenna and a wireless communications device.

BACKGROUND

Common frequency bands of a wireless local area network (WLAN) include a 2.4 gigahertz (GHz) frequency band and a 5 GHz frequency band. Compared with a WLAN device that uses two antennas operating on different frequency bands, a WLAN device that uses a dual-band antenna is deployed more conveniently. However, the dual-band antenna has a large size.

SUMMARY

This application provides a dual-band antenna and a wireless communications device, to implement a miniaturized dual-band antenna.

According to a first aspect, a dual-band antenna is provided. The dual-band antenna includes a first antenna arranged on a first printed circuit board (PCB), a second antenna arranged on a second PCB, and a reflection panel. An operating frequency band of the first antenna is a first frequency band. An operating frequency band of the second antenna is a second frequency band. The first frequency band is higher than the second frequency band. The second PCB is disposed between the first PCB and the reflection panel. The reflection panel includes an artificial magnetic conductor. A resonant frequency band of the artificial magnetic conductor includes the second frequency band. The first frequency band is outside the resonant frequency band.

A distance between an antenna and a reflection panel is generally approximately a quarter of a wavelength of an electromagnetic wave whose frequency is within a range of an operating frequency band and that is in a medium. The foregoing dual-band antenna uses the reflection panel that includes an artificial magnetic conductor to reduce a distance between the second PCB and the reflection panel such that the second PCB is disposed between the first PCB and the reflection panel. A volume of a dual-band antenna is a product of an area of a PCB and a distance between a reflection panel and a PCB that is farthest away from the reflection panel. Therefore, a volume of the foregoing dual-band antenna decreases from a product of an area of a PCB and a quarter of a wavelength of an electromagnetic wave whose frequency is within a range of the second frequency band and that is in a medium to a product of the area of the PCB and a quarter of a wavelength of an electromagnetic wave whose frequency is within a range of the first frequency band and that is in a medium.

Optionally, the first antenna and the second antenna are microstrip antennas such that a size of the foregoing dual-band antenna is reduced.

With reference to the first aspect, in a first implementation of the first aspect, a projection of the first antenna on the second PCB only partially covers the second antenna in order to reduce shielding caused by the first antenna on the second antenna.

With reference to the first implementation of the first aspect, in a second implementation of the first aspect, the second antenna includes a first element, a second element, and a power divider. A first branch of the power divider is connected to the first element, and a second branch of the power divider is connected to the second element. The first element is covered by the projection of the first antenna on the second PCB. At least one part of the second element is outside the projection of the first antenna on the second PCB. A length of the second branch is greater than a length of the first branch.

The projection of the first antenna on the second PCB only partially covers the second antenna. Therefore, when an electromagnetic wave emitted by the second antenna passes through the first antenna, a phase of the electromagnetic wave is affected. As a result, directivity of the electromagnetic wave emitted by the second antenna may be affected. To correct a direction of the electromagnetic wave emitted by the second antenna, one branch of the power divider in the foregoing implementation is extended to compensate a phase difference between the two elements. In this way, the direction of the electromagnetic wave emitted by the second antenna is corrected.

With reference to the first aspect, in a third implementation of the first aspect, a projection of the first antenna on the second PCB only partially covers the second antenna. The first antenna includes a plurality of elements, and the plurality of elements of the first antenna are arranged at an edge of the first PCB. The second antenna includes a plurality of elements. Projections of centers of the plurality of elements of the second antenna on the first PCB are located within a graph enclosed by centers of the plurality of elements of the first antenna. This implementation is an optional manner of reducing, in a multi-element structure, shielding caused by the first antenna on the second antenna. In this implementation, an electromagnetic wave emitted by the second antenna is not shielded when passing through a middle part of the first PCB.

With reference to the third implementation of the first aspect, in a fourth implementation of the first aspect, each of the plurality of elements of the second antenna includes a first element, a second element, and a power divider. A first branch of the power divider is connected to the first element. A second branch of the power divider is connected to the second element. The first element is covered by the projection of the first antenna on the second PCB. At least one part of the second element is outside the projection of the first antenna on the second PCB. A length of the second branch is greater than a length of the first branch. This implementation is an optional manner of correcting, in a multi-element structure, a direction of an electromagnetic wave emitted by the second antenna.

With reference to the fourth implementation of the first aspect, in a fifth implementation of the first aspect, each of the plurality of elements of the first antenna includes a plurality of dipole microstrip elements. High power is allocated to a dipole microstrip element, of the plurality of dipole microstrip elements, that is in a central position. Low power is allocated to a dipole microstrip element, of the plurality of dipole microstrip elements, that is in a surrounding position. If a frequency of the first frequency band is a multiple of a frequency of the second frequency band, an electromagnetic wave emitted by the first antenna may affect the electromagnetic wave emitted by the second antenna. The high power is allocated to the dipole microstrip element, of the plurality of dipole microstrip elements, that is in the central position, an energy center of the electromagnetic wave emitted by the first antenna covers only a part of the second antenna, thereby reducing impact of a frequency multiplication electromagnetic wave on the second antenna.

According to a second aspect, a wireless communications device is provided, including the dual-band antenna according to any one of the first aspect or the first implementation to the fourth implementation of the first aspect. The wireless communications device further includes a first radio frequency circuit whose operating frequency band is the first frequency band and a second radio frequency circuit whose operating frequency band is the second frequency band. The first radio frequency circuit is connected to the first antenna. The second radio frequency circuit is connected to the second antenna.

DESCRIPTION OF EMBODIMENTS

The following describes the embodiments of the present disclosure with reference to FIG. 1 to FIG. 4.

Figure 1:
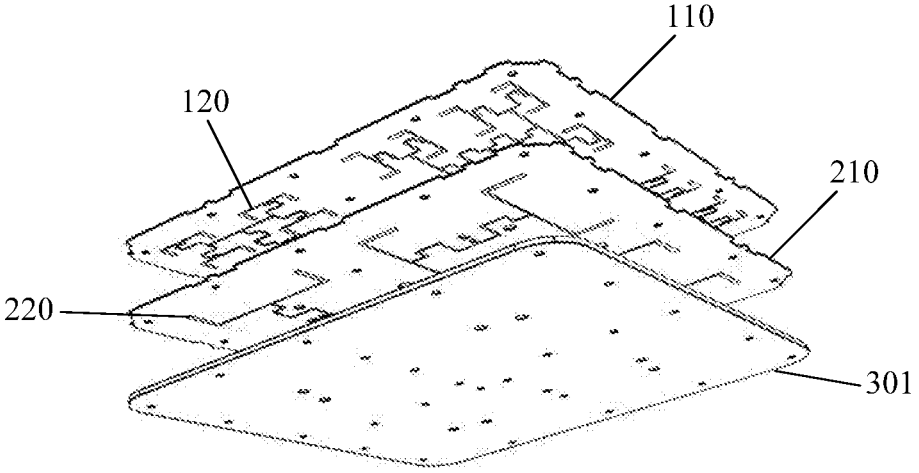
FIG. 1 is a three-dimensional schematic diagram of a dual-band antenna from an angle of view according to an embodiment of the present disclosure.
Figure 2:
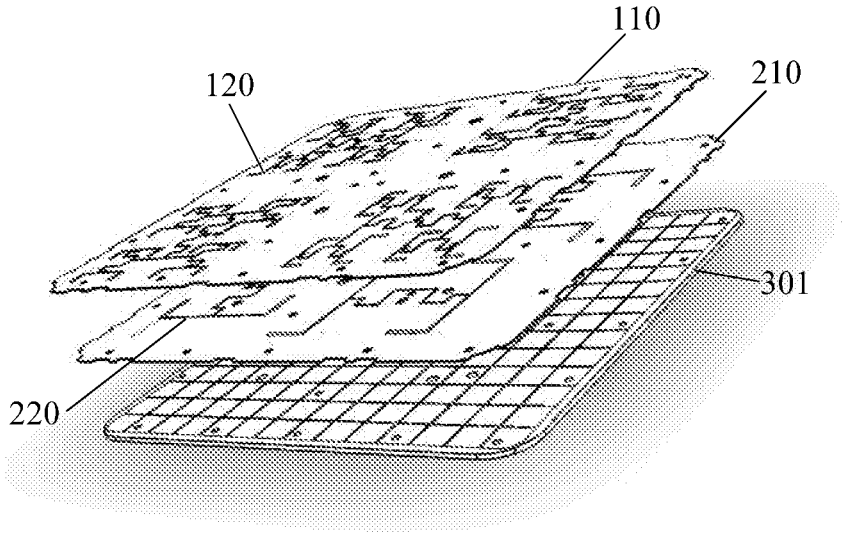
FIG. 2 is a three-dimensional schematic diagram of a dual-band antenna from another angle of view according to an embodiment of the present disclosure.

FIG. 1 and FIG. 2 are three-dimensional schematic diagrams of a dual-band antenna according to an embodiment of the present disclosure. The dual-band antenna includes a first antenna 120 arranged on a first PCB 110 and a second antenna 220 arranged on a second PCB 210. The dual-band antenna further includes a reflection panel 301. The first PCB 110, the second PCB 210, and the reflection panel 301 are parallel to each other.

To reduce a size of the dual-band antenna, the first antenna 120 and the second antenna 220 are microstrip antennas. An operating frequency band of the first antenna 120 is a first frequency band. An operating frequency band of the second antenna 220 is a second frequency band. The first frequency band is higher than the second frequency band. That the first frequency band is higher than the second frequency band means that a lower limit of a frequency range of the first frequency band is higher than an upper limit of a frequency range of the second frequency band. For example, the first frequency band is a 5 GHz frequency band, and the second frequency band is a 2.4 GHz frequency band. Although there are some differences in regulations in countries, a lower limit of a frequency range of the 5 GHz frequency band is definitely higher than an upper limit of a frequency range of the 2.4 GHz frequency band. A regulation in the United States is used as an example. A range of the 2.4 GHz frequency band is from 2400 megahertz (MHz) to 2483.5 MHz, and a range of the 5 GHz frequency band is from 5170 MHz to 5835 MHz. A lower limit 5170 MHz of the 5 GHz frequency band is higher than an upper limit 2483.5 MHz of the 2.4 GHz frequency band.

The reflection panel 301 is a conductor ground panel. The reflection panel 301 cooperates with the microstrip antennas such that the electromagnetic waves generated by the microstrip antennas have good directivity. A distance between an antenna and the reflection panel 301 is determined by an operating frequency band of the antenna and a nature of a medium between the antenna and the reflection panel 301. The distance between the antenna and the reflection panel 301 is generally approximately a quarter of a wavelength of an electromagnetic wave whose frequency is within a range of an operating frequency band and that is in a medium in order to improve a gain of a microstrip antenna. Because the first frequency band is higher than the second frequency band, a wavelength of an electromagnetic wave of the first frequency band in a medium is less than a wavelength of an electromagnetic wave of the second frequency band in the same medium. Therefore, if the reflection panel 301 is replaced by a common metal ground panel, a distance between the first antenna 120 and the common metal ground panel should be less than a distance between the second antenna 220 and the common metal ground panel. Hence, the first PCB 110 is disposed between the second PCB 210 and the common metal ground panel.

A size of an antenna is inversely proportional to a frequency of an electromagnetic wave of an operating frequency band of the antenna. Therefore, when the first antenna 120 and the second antenna 220 use a same structure, a size of the first antenna 120 is less than a size of the second antenna 220. The electromagnetic wave of the antenna is transmitted along a direction from the reflection panel 301 to the antenna. This direction is a forward direction of the antenna. Because the antenna is a conductor, an electromagnetic wave emitted by a rear antenna is shielded by a front antenna. If the first PCB 110 is disposed between the second PCB 210 and the reflection panel 301, that is, the second PCB 210 is in front of the first PCB 110, the second antenna 220 shields an electromagnetic wave emitted by the first antenna 120. Therefore, the second antenna 220 of a larger size has a high shielding effect on the electromagnetic wave emitted by the first antenna 120.

To reduce mutual shielding caused by the two antennas of the dual-band antenna on the electromagnetic waves, the second PCB 210 is disposed between the first PCB 110 and the reflection panel 301. A distance between the first PCB 110 and the reflection panel 301 is set to a general distance, that is, approximately a quarter of the wavelength of the electromagnetic wave of the first frequency band in the medium. To maintain a high gain of the second antenna 220 with a distance from the reflection panel 301 less than the general distance, an artificial magnetic conductor (also referred to as AMC) is used to fabricate the reflection panel 301 in order to change a phase of an electromagnetic wave between the second antenna 220 and the reflection panel 301. The AMC is an artificial metal electromagnetic structure. The AMC usually has a periodic pattern corresponding to a resonant frequency band of the AMC. For an electromagnetic wave within the resonant frequency band of the AMC, the AMC is a perfect magnetic conductor (PMC). For an electromagnetic wave outside the resonant frequency band of the AMC, the AMC is a common reflection panel. The reflection panel 301 including the AMC can change a phase of the electromagnetic wave within the resonant frequency band, thereby reducing a required distance between the reflection panel 301 and an antenna. To reduce the distance between the second antenna 220 and the reflection panel 301 without changing a distance between the first antenna 120 and the reflection panel 301, the resonant frequency band of the AMC includes the second frequency band, and does not include the first frequency band. Hence, the first frequency band is outside the resonant frequency band of the AMC.

When the reflection panel including the AMC is used, the second PCB 210 is disposed between the first PCB 110 and the reflection panel 301, that is, the first PCB 110 is in front of the second PCB 210. The first antenna 120 of a smaller size has a low shielding effect on an electromagnetic wave emitted by the second antenna 220, thereby leading to an overall decrease in mutual shielding caused by the two antennas of the dual-band antenna on the electromagnetic waves. In addition, a volume of a dual-band antenna is a product of an area of a PCB and a distance between the reflection panel 301 and a PCB that is farthest away from the reflection panel 301. Therefore, compared with a dual-band antenna that does not include the AMC, a volume of a dual-band antenna including the AMC decreases from a product of an area of a PCB and a quarter of the wavelength of the electromagnetic wave of the second frequency band in a medium to a product of the area of the PCB and a quarter of the wavelength of the electromagnetic wave of the first frequency band in the medium. An example in which the first frequency band is the 5 GHz frequency band and the second frequency band is the 2.4 GHz frequency band is used. A volume of the dual-band antenna that uses the reflection panel including the AMC is approximately half of a volume of a dual-band antenna that uses a common metal ground panel.

To further reduce shielding caused by the first antenna 120 on the second antenna 220, the first antenna 120 may be offset such that a projection of the first antenna 120 on the second PCB 210 only partially covers the second antenna 220.

Figure 3:
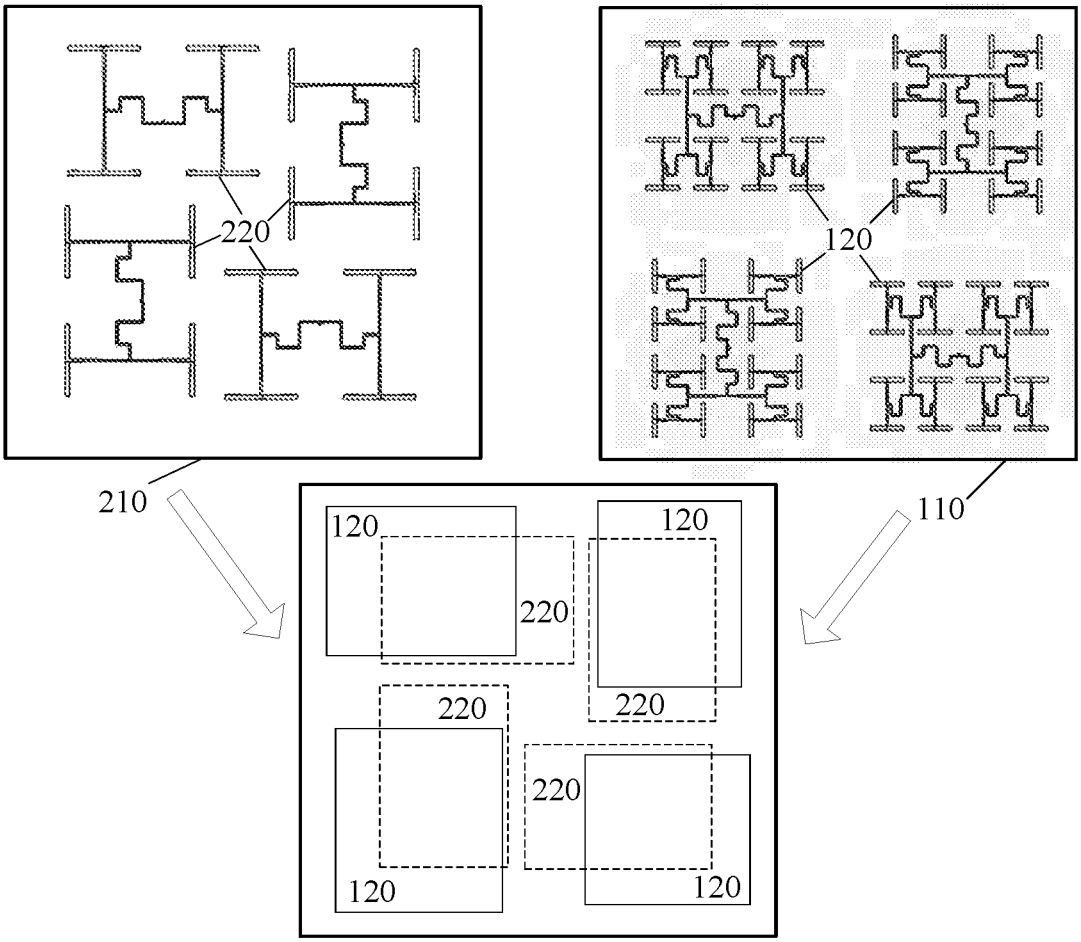
FIG. 3 is a schematic diagram of a dual-band antenna in which a first antenna is offset according to an embodiment of the present disclosure.

The entire first antenna 120 may be moved for a distance such that a projection of a center of the first antenna 120 deviates from a center of the second antenna 220. In this way, the first antenna 120 is offset. As shown in FIG. 3, if the first antenna 120 and the second antenna 220 each include a plurality of elements, the plurality of elements of the first antenna 120 may be arranged at an edge of the first PCB 110 such that the first antenna 120 is offset and a part between the elements is enlarged. The second antenna 220 is still arranged in a conventional manner. In this way, projections of centers of the plurality of elements of the second antenna 220 on the first PCB 110 are located within a graph enclosed by centers of the plurality of elements of the first antenna 120 such that the electromagnetic wave emitted by the second antenna 220 is not shielded by the first antenna 120 when passing through the part between the elements.

Referring to FIG. 3, FIG. 3 shows a structure of a dual-band antenna using an example in which the first antenna 120 and the second antenna 220 each include four elements. A PCB in an upper right part in FIG. 3 is the first PCB 110, and the first antenna 120 is arranged on the first PCB 110. The four elements of the first antenna 120 are arranged in four corners of the first PCB 110, thereby leaving parts between the elements. A PCB in an upper left part in FIG. 3 is the second PCB 210, and the second antenna 220 is arranged on the second PCB 210. The second antenna 220 is arranged in a conventional manner. A lower part in FIG. 3 is a schematic diagram showing that the second antenna 220 is projected on the first PCB 110 after the dual-band antenna is installed. The first antenna 120 is represented by a solid line box. A projection of the second antenna 220 is represented by a dashed line box.

If a projection of the first antenna 120 on the second PCB 210 only partially covers the second antenna 220, a phase of a part, of an electromagnetic wave emitted by the second antenna 220, that passes through the first antenna 120 is affected. As a result, directivity of the electromagnetic wave emitted by the second antenna 220 may be affected.

If the second antenna 220 includes at least two elements, a phase of each element may be adjusted to correct a direction of the electromagnetic wave emitted by the second antenna 220. For example, the second antenna 220 includes a first element, a second element, and a power divider. A first branch of the power divider is connected to the first element. A second branch of the power divider is connected to the second element. The first element is covered by the projection of the first antenna 120 on the second PCB 210. At least one part of the second element is outside the projection of the first antenna 120. Hence, compared with an electromagnetic wave emitted by the second element, a phase of an electromagnetic wave emitted by the first element is delayed. Correspondingly, a length of the second branch is increased (the length of the second branch is greater than a length of the first branch). Compared with a radio frequency signal transmitted by a short branch, a phase of a radio frequency signal transmitted by a long branch is delayed. A phase of the electromagnetic wave emitted by the second element is delayed such that phases of the electromagnetic waves emitted by the first element and the second element are the same, and a direction of the electromagnetic wave emitted by the second antenna 220 is corrected.

Figure 4:
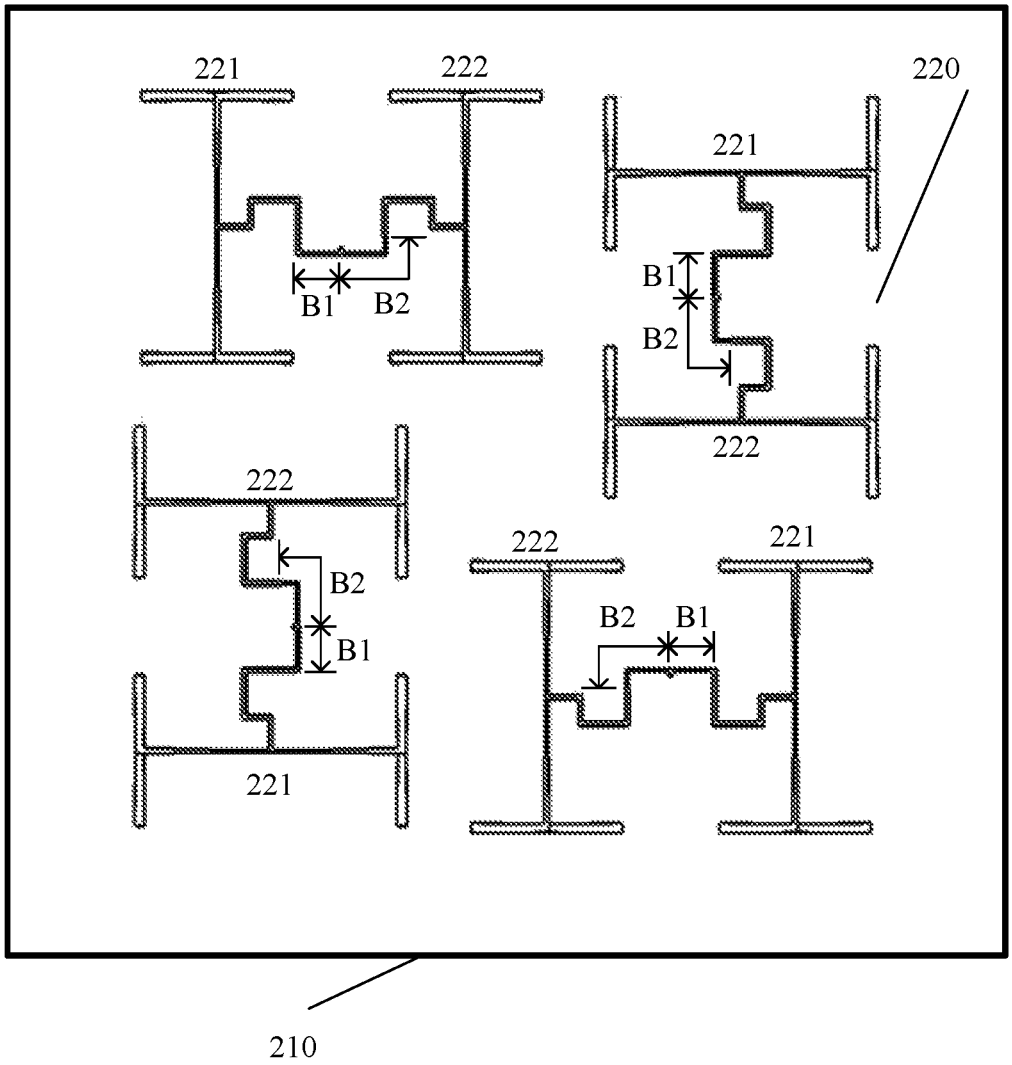
FIG. 4 is a schematic diagram of a second antenna with an element phase adjustment structure according to an embodiment of the present disclosure.

Referring to FIG. 4, FIG. 4 is a schematic diagram of a second antenna 220 with an element phase adjustment structure. If the first antenna 120 and the second antenna 220 each include a plurality of elements, the plurality of elements of the first antenna 120 are arranged at an edge of the first PCB 110, and each of the plurality of elements of the second antenna 220 includes at least two elements, a structure of each of the plurality of elements of the second antenna 220 may be adjusted to correct a direction of an electromagnetic wave emitted by the second antenna 220. For example, each of the plurality of elements of the second antenna 220 includes a first element 221, a second element 222, and a power divider. A first branch B1 of the power divider is connected to the first element 221. A second branch B2 of the power divider is connected to the second element 222. The first element 221 is covered by a projection of the first antenna 120 on the second PCB 210. At least one part of the second element 222 is outside the projection of the first antenna 120. A length of the second branch B2 is greater than a length of the first branch B1.

If a first frequency band is a 5 GHz frequency band, and a second frequency band is a 2.4 GHz frequency band, an electromagnetic wave emitted by the first antenna 120 may affect the electromagnetic wave emitted by the second antenna 220, because a frequency of the first frequency band is approximately twice a frequency of the second frequency band. To reduce impact of a frequency multiplication electromagnetic wave on an electromagnetic wave of the second frequency band, power allocation of the elements of the first antenna 120 may be adjusted to make an energy center of the electromagnetic wave emitted by the first antenna 120 cover only a part of the second antenna 220. For example, the first antenna 120 in FIG. 3 is used as an example. The first antenna 120 includes four antenna element groups. Each antenna element group includes 16 (4×4) dipole microstrip elements. Power allocation of the 16 dipole microstrip elements may be adjusted such that high power is allocated to four dipole microstrip elements, of the 16 dipole microstrip elements, that is in a central position, and low power is allocated to 12 dipole microstrip elements, of the 16 dipole microstrip elements, that is in a surrounding position. In this way, an energy center of each antenna element group of the first antenna 120 covers only the first element 221 of the second antenna 220, thereby reducing impact of a frequency multiplication electromagnetic wave on the second antenna 220.

A quantity of elements in each of the first antenna 120 and the second antenna 220 may be any positive integer. The first antenna 120 and the second antenna 220 may have different quantities of elements. FIG. 1 to FIG. 4 show schematic diagrams of the dual-band antennas in the embodiments of the present disclosure using an example in which the first antenna 120 and the second antenna 220 each include four elements.

Figure 5:
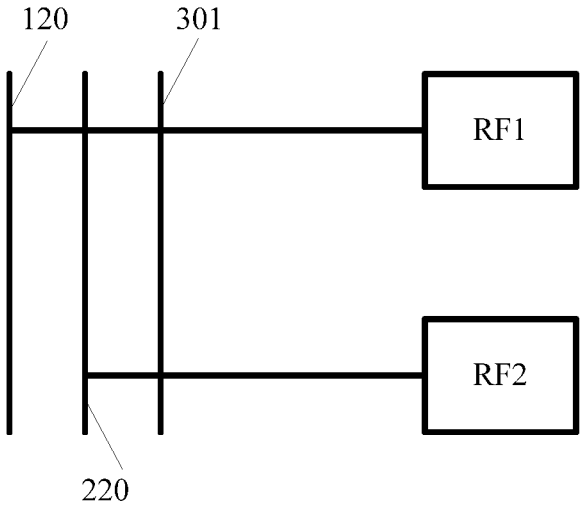
FIG. 5 is a schematic diagram of a wireless communications device according to an embodiment of the present disclosure.

FIG. 5 is a schematic diagram of a wireless communications device according to an embodiment of the present disclosure. The wireless communications device includes the dual-band antenna according to any one of the embodiments shown in FIG. 1 to FIG. 4, a first radio frequency (also referred to as RF) circuit RF1 whose operating frequency band is a first frequency band, and a second RF circuit RF2 whose operating frequency band is a second frequency band. The first RF circuit RF1 is connected to a first antenna 120. The second RF circuit RF2 is connected to a second antenna 220. An RF circuit is also referred to as an RF module, and is configured to receive and transmit an RF signal. The first RF circuit RF1 and the second RF circuit RF2 may be integrated into one chip, or may be chips independent from each other.

Figure 6:
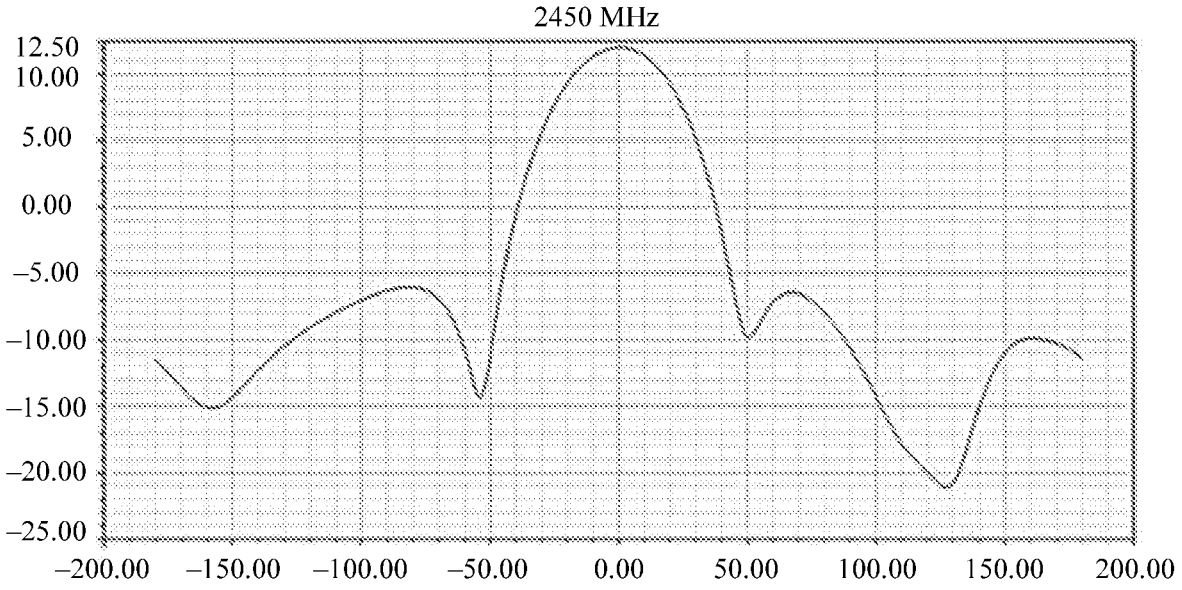
FIG. 6 is a directivity pattern of a 2.4 GHz frequency band of a dual-band antenna according to an embodiment of the present disclosure.

FIG. 6 is a directivity pattern of a 2.4 GHz frequency band of a dual-band antenna according to an embodiment of the present disclosure. FIG. 6 shows, using a 2450 MHz signal as an example, a gain, in each direction, of a dual-band antenna that uses a structure in the embodiments shown in FIG. 1 to FIG. 4. A horizontal axis represents an angle and is in a unit of degree. 0 degrees represent a right ahead direction of the dual-band antenna. A range of the horizontal axis is from −200 degrees to 200 degrees. A range from ~180 degrees to 180 degrees is a valid range. A vertical axis represents a gain and is in a unit of decibel (dB). A range of the vertical axis is from −25 dB to 12.5 dB.

Figure 7:
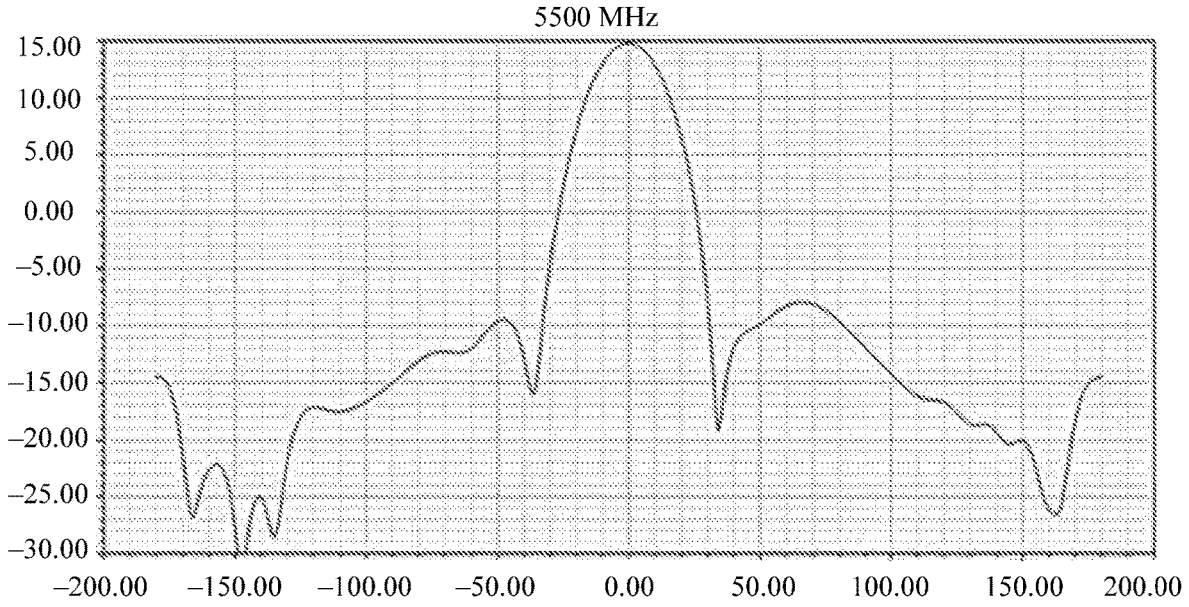
FIG. 7 is a directivity pattern of a 5 GHz frequency band of a dual-band antenna according to an embodiment of the present disclosure.

FIG. 7 is a directivity pattern of a 5 GHz frequency band of a dual-band antenna according to an embodiment of the present disclosure. FIG. 7 shows, using a 5500 MHz signal as an example, a gain, in each direction, of a dual-band antenna that uses a structure in the embodiments shown in FIG. 1 to FIG. 4. A horizontal axis represents an angle and is in a unit of degree. 0 degrees represent a right ahead direction of the dual-band antenna. A range of the horizontal axis is from −200 degrees to 200 degrees. A range from −180 degrees to 180 degrees is a valid range. A vertical axis represents a gain and is in a unit of dB. A range of the vertical axis is from −30 dB to 15 dB.

It can be learned from FIG. 6 and FIG. 7 that the dual-band antenna using the structure in the embodiments of the present disclosure has good directivity and a high gain.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A dual-band antenna comprising:

a first printed circuit board (PCB);

a first antenna arranged on the first PCB, wherein a first operating frequency band of the first antenna is a first frequency band;

a second PCB;

a second antenna arranged on the second PCB, wherein a second operating frequency band of the second antenna is a second frequency band that is lower than the first frequency band, and wherein both the first antenna and the second antenna are dipole antennas; and a reflection panel serving as a reflector for the first antenna and the second antenna, comprising an artificial magnetic conductor, and positioned such that the second PCB is disposed between the first PCB and the reflection panel, wherein a resonant frequency band of the artificial magnetic conductor comprises the second frequency band, and wherein the first frequency band is outside the resonant frequency band.

2. The dual-band antenna of claim 1, wherein a projection of the first antenna on the second PCB partially covers the second antenna.

3. The dual-band antenna of claim 2, wherein the second antenna comprises a first element, a second element, and a power divider, a first branch of the power divider is connected to the first element, and a second branch of the power divider is connected to the second element, the first element is covered by the projection of the first antenna on the second PCB, at least one part of the second element is outside the projection of the first antenna on the second PCB, and a length of the second branch is greater than a length of the first branch.

4. The dual-band antenna of claim 1, wherein a projection of the first antenna on the second PCB partially covers the second antenna, the first antenna comprises a plurality of elements, the plurality of elements of the first antenna are arranged at an edge of the first PCB, the second antenna comprises a plurality of elements, and projections of centers of the plurality of elements of the second antenna on the first PCB are located within a graph enclosed by centers of the plurality of elements of the first antenna.

5. The dual-band antenna of claim 4, wherein each of the plurality of elements of the second antenna comprises a first element, a second element, and a power divider, a first branch of the power divider is connected to the first element, a second branch of the power divider is connected to the second element, the first element is covered by the projection of the first antenna on the second PCB, at least one part of the second element is outside the projection of the first antenna on the second PCB, and a length of the second branch is greater than a length of the first branch.

6. The dual-band antenna of claim 1, wherein the first antenna and the second antenna are microstrip antennas.

7. The dual-band antenna of claim 5, wherein a frequency of the first frequency band is a multiple of a frequency of the second frequency band, each of the plurality of elements of the first antenna comprises a plurality of dipole microstrip elements, high power is allocated to a dipole microstrip element, of the plurality of dipole microstrip elements, that is in a central position, and low power is allocated to a dipole microstrip element, of the plurality of dipole microstrip elements, that is in a surrounding position.

8. The dual-band antenna of claim 1, wherein the reflection panel is a conductor ground panel configured to cooperate with the first antenna and the second antenna.

9. The dual-band antenna of claim 1, wherein the first PCB, the second PCB, and the reflection panel are parallel to each other.

10. A wireless communications device comprising:

a dual-band antenna comprising:

a first printed circuit board (PCB);

a first antenna arranged on the first PCB, wherein an operating frequency band of the first antenna is a first frequency band;

a second PCB;

a second antenna arranged on the second PCB, wherein an operating frequency band of the second antenna is a second frequency band that is lower than the first frequency band, and wherein both the first antenna and the second antenna are dipole antennas; and a reflection panel serving as a reflector for the first antenna and the second antenna, comprising an artificial magnetic conductor, and positioned such that the second PCB is disposed between the first PCB and the reflection panel, wherein a resonant frequency band of the artificial magnetic conductor comprises the second frequency band, and wherein the first frequency band is outside the resonant frequency band;

a first radio frequency circuit connected to the first antenna, wherein an operating frequency band of the first radio frequency circuit is the first frequency band; and a second radio frequency circuit connected to the second antenna, wherein an operating frequency band of the first radio frequency circuit is the second frequency band.

11. The wireless communications device of claim 10, wherein a projection of the first antenna on the second PCB partially covers the second antenna.

12. The wireless communications device of claim 11, wherein the second antenna comprises a first element, a second element, and a power divider, a first branch of the power divider is connected to the first element, a second branch of the power divider is connected to the second element, the first element is covered by the projection of the first antenna on the second PCB, at least one part of the second element is outside the projection of the first antenna on the second PCB, and a length of the second branch is greater than a length of the first branch.

13. The wireless communications device of claim 10, wherein a projection of the first antenna on the second PCB partially covers the second antenna, the first antenna comprises a plurality of elements, the plurality of elements of the first antenna are arranged at an edge of the first PCB, the second antenna comprises a plurality of elements, and projections of centers of the plurality of elements of the second antenna on the first PCB are located within a graph enclosed by centers of the plurality of elements of the first antenna.

14. The wireless communications device of claim 13, wherein each of the plurality of elements of the second antenna comprises a first element, a second element, and a power divider, a first branch of the power divider is connected to the first element, a second branch of the power divider is connected to the second element, the first element is covered by the projection of the first antenna on the second PCB, at least one part of the second element is outside the projection of the first antenna on the second PCB, and a length of the second branch is greater than a length of the first branch.

15. The wireless communications device of claim 14, wherein a frequency of the first frequency band is a multiple of a frequency of the second frequency band, each of the plurality of elements of the first antenna comprises a plurality of dipole microstrip elements, high power is allocated to a dipole microstrip element, of the plurality of dipole microstrip elements, that is in a central position, and low power is allocated to a dipole microstrip element, of the plurality of dipole microstrip elements, that is in a surrounding position.

16. The wireless communications device of claim 10, wherein the first antenna and the second antenna are microstrip antennas.

17. The wireless communications device of claim 10, wherein the reflection panel is a conductor ground panel configured to cooperate with the first antenna and the second antenna.

18. The wireless communications device of claim 17, wherein the first antenna and the second antenna are configured to generate electromagnetic waves, and wherein the reflection panel is further configured to provide directivity of the electromagnetic waves.

19. The wireless communications device of claim 10, wherein the first PCB, the second PCB, and the reflection panel are parallel to each other.

20. The dual-band antenna of claim 8, wherein the first antenna and the second antenna are configured to generate electromagnetic waves, and wherein the reflection panel is further configured to provide directivity of the electromagnetic waves.

* * * * *